US008350498B2

(12) United States Patent
Ling

(10) Patent No.: US 8,350,498 B2
(45) Date of Patent: Jan. 8, 2013

(54) DYNAMIC CURRENT EQUALIZATION FOR LIGHT EMITTING DIODE (LED) AND OTHER APPLICATIONS

(75) Inventor: Hok-Sun Ling, Fanling (HK)

(73) Assignee: National Semiconductor Corporation, Santa Clara, CA (US)

( * ) Notice: Subject to any disclaimer, the term of this patent is extended or adjusted under 35 U.S.C. 154(b) by 278 days.

(21) Appl. No.: 12/799,611

(22) Filed: Apr. 28, 2010

(65) Prior Publication Data

US 2011/0266972 A1 Nov. 3, 2011

(51) Int. Cl.
*H05B 37/02* (2006.01)
*G09G 3/14* (2006.01)

(52) U.S. Cl. ..... 315/297; 315/291; 315/250; 315/282; 315/308; 345/46; 345/82; 345/77

(58) Field of Classification Search ..... 315/185 R, 315/192, 210, 224, 209 R, 294, 308, 309, 315/312, 324; 345/46, 82, 77, 204, 212
See application file for complete search history.

(56) References Cited

U.S. PATENT DOCUMENTS

| | | | |
|---|---|---|---|
| 5,396,188 | A | 3/1995 | Aoki |
| 5,420,499 | A | 5/1995 | DeShazo |
| 6,084,465 | A | 7/2000 | Dasgupta |
| 6,239,654 | B1 | 5/2001 | Yamamoto |
| 6,583,609 | B1 | 6/2003 | Pardoen |
| 6,606,257 | B2 | 8/2003 | Bourdillon |
| 6,683,419 | B2 | 1/2004 | Kriparos |
| 6,784,728 | B2 | 8/2004 | Fischer |
| 6,844,760 | B2 | 1/2005 | Koharagi et al. |
| 6,871,289 | B2 | 3/2005 | Pullen et al. |
| 7,058,373 | B2 | 6/2006 | Grigore |

(Continued)

FOREIGN PATENT DOCUMENTS

KR 1020100017050 2/2010

OTHER PUBLICATIONS

Tawen Mei, et al., "Circuit and Method for Average-Current Regulation of Light-Emitting Diodes", U.S. Appl. No. 11/703,981, filed Feb. 8, 2007.

(Continued)

*Primary Examiner* — Vibol Tan
(74) *Attorney, Agent, or Firm* — Wade J. Brady, III; Frederick J. Telecky, Jr.

(57) ABSTRACT

A system includes multiple dynamic current equalizers (DCEs). Each DCE includes a first control loop configured to regulate a current through a circuit branch associated with the dynamic current equalizer. The first control loop includes a first amplifier having two inputs. Each DCE also includes a second control loop configured to regulate a control signal. The second control loop includes a second amplifier having two inputs coupled to the inputs of the first amplifier. The first amplifier has an input offset compared to the second amplifier. The DCEs are configured such that one DCE regulates the control signal while one or more other DCEs regulate the currents through the associated circuit branches based on the control signal. The DCEs can be configured to achieve one or more ratios between multiple currents flowing through multiple circuit branches, where the one or more ratios are defined by resistances coupled to the DCEs.

20 Claims, 9 Drawing Sheets

U.S. PATENT DOCUMENTS

| | | | | |
|---|---|---|---|---|
| 7,061,394 | B2 * | 6/2006 | Biebl | 340/815.45 |
| 7,115,888 | B2 | 10/2006 | Hachiya et al. | |
| 7,132,820 | B2 | 11/2006 | Walters et al. | |
| 7,221,134 | B1 | 5/2007 | Ling | |
| 7,388,359 | B1 | 6/2008 | Ling | |
| 7,425,819 | B2 | 9/2008 | Isobe | |
| 7,443,209 | B2 | 10/2008 | Chang | |
| 7,579,819 | B1 | 8/2009 | Ling | |
| 7,595,622 | B1 | 9/2009 | Tomiyoshi et al. | |
| 7,671,573 | B1 | 3/2010 | Ling et al. | |
| 7,714,517 | B2 * | 5/2010 | Shih et al. | 315/291 |
| 7,902,768 | B2 * | 3/2011 | Zanforlin | 315/282 |
| 7,928,670 | B2 * | 4/2011 | Chen et al. | 315/308 |
| 7,977,891 | B2 * | 7/2011 | Shiu et al. | 315/291 |
| 8,018,170 | B2 * | 9/2011 | Chen et al. | 315/192 |
| 8,148,911 | B2 * | 4/2012 | Chen et al. | 315/250 |
| 2007/0132439 | A1 | 6/2007 | Tsuzaki | |
| 2008/0061716 | A1 | 3/2008 | Kim et al. | |
| 2009/0096739 | A1 | 4/2009 | Lan et al. | |
| 2009/0153066 | A1 | 6/2009 | Yang et al. | |
| 2010/0084983 | A1 | 4/2010 | Shiu et al. | |

OTHER PUBLICATIONS

"PWM LED Driver and Boost, Flyback and SEPIC Controller", Linear Technology Corporation 2005, 24 pages.

"Constant Current LED Driver with Digital and PWM Brightness Control", Texas Instruments, Nov. 2004, 25 pages.

Prathyusha Narra, et al., "An Effective LED Dimming Approach", 2004 IEEE, pg. 1671-1676.

T. Suntio et al., "Dynamic Effects of Inductor Current Ripple in Average Current Mode Control", 2001 IEEE, pp. 1259-1264.

Zaohong Yang et al., "DC-To-DC Buck Converters with Novel Current Mode Control", 1999 IEEE, pp. 1158-1164.

Lawrence Hok-Sun Ling, "System and Method for Providing a Pulsating Current Output Having Ultra Fast Rise and Fall Times", U.S. Appl. No. 11/731,961, filed Apr. 2, 2007.

Notification of Transmittal of the International Search Report and the Written Opinion of the International Searching Authority, or the Declaration dated Nov. 23, 2011 in connection with International Patent Application No. PCT/US2011/034369.

* cited by examiner

DYNAMIC CURRENT EQUALIZATION FOR LIGHT EMITTING DIODE (LED) AND OTHER APPLICATIONS

TECHNICAL FIELD

This disclosure is generally directed to light emitting diode (LED) systems and other systems that can use current equalization. More specifically, this disclosure relates to dynamic current equalization for LED and other applications.

BACKGROUND

Many systems use light emitting diodes (LEDs) to generate light. For example, LEDs are often used in traffic control devices to generate light of different colors. As a particular example, a traffic lamp may use LED panels to generate red, yellow, and green light. Each LED panel could include multiple strings of LEDs, where each string includes multiple LEDs coupled in series. Each string generates light when a current flows through that string.

A problem with conventional LED devices is that individual LED strings can fail, which interrupts the current through the string. When this happens, the amount of light that is generated by the LED panel drops, which requires maintenance of the panel and the associated time, effort, and cost.

BRIEF DESCRIPTION OF THE DRAWINGS

For a more complete understanding of this disclosure and its features, reference is now made to the following description, taken in conjunction with the accompanying drawings, in which.

DETAILED DESCRIPTION

FIGS. 1 through 9, discussed below, and the various embodiments used to describe the principles of the present invention in this patent document are by way of illustration only and should not be construed in any way to limit the scope of the invention. Those skilled in the art will understand that the principles of the invention may be implemented in any type of suitably arranged device or system.

Figure 1:
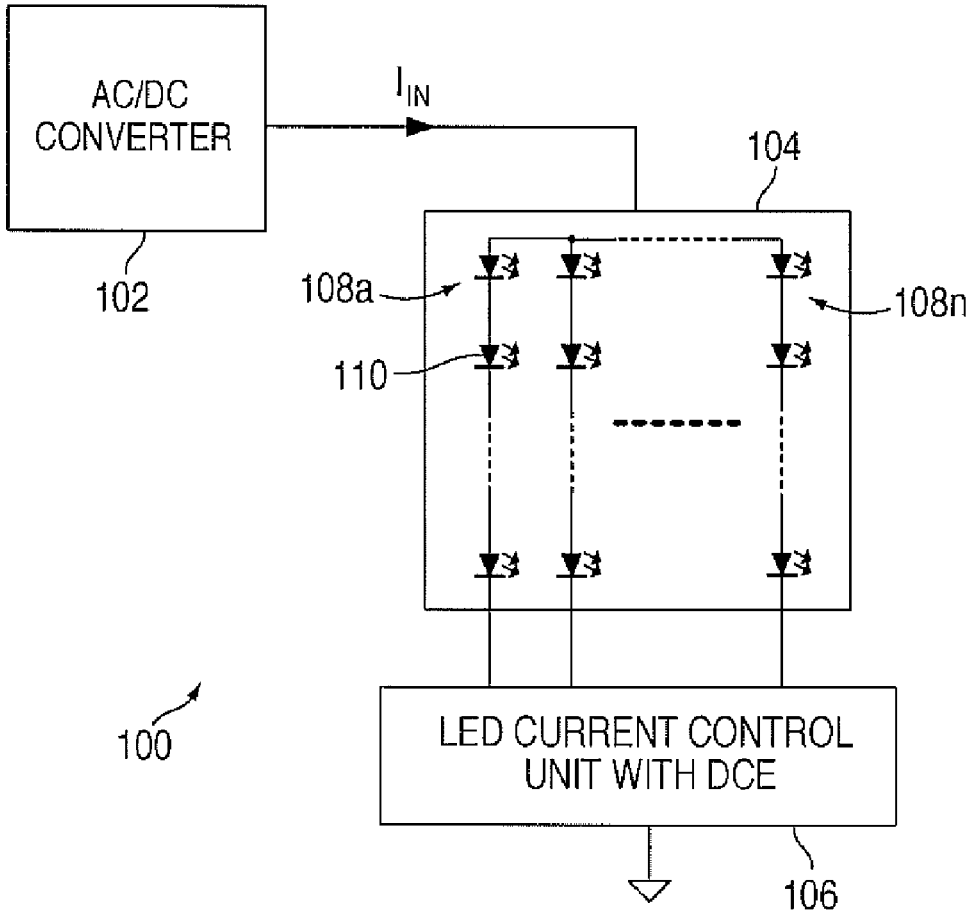
FIG. 1 illustrates an example light emitting diode (LED) system according to this disclosure.

FIG. 1 illustrates an example light emitting diode (LED) system 100 according to this disclosure. In this example, the system 100 includes an alternating current-to-direct current (AC/DC) converter 102, an LED panel 104, and a current control unit 106. The AC/DC converter 102 receives an AC input signal and generates a DC output signal. For example, the AC/DC converter 102 could generate a DC input current $I_{IN}$ for the LED panel 104. The AC/DC converter 102 includes any suitable structure for converting an AC signal into a DC signal. As a particular example, the AC/DC converter 102 could represent a converter operating in a constant current (CC) mode, such as a converter that generates a 3 A current.

The LED panel 104 here includes multiple strings 108*a*-108*n*. Each string 108*a*-108*n* includes multiple LEDs 110 coupled in series, and the strings 108*a*-108*n* are coupled in parallel with each other. Each string 108*a*-108*n* can include any number of LEDs 110, any suitable number of strings could be coupled in parallel, and any other suitable configuration of LEDs 110 can be used. Each LED 110 includes any suitable semiconductor device for generating light. In this example, the LED panel 104 receives the input current $I_{IN}$, which causes the LEDs 110 in the strings 108*a*-108*n* to generate light. The amount of current flowing through an LED string controls the amount of illumination provided by that string. Higher currents typically result in more illumination, while lower currents typically result in less illumination.

During operation, one or more of the LED strings 108*a*-108*n* can fail. This could be due to any number of reasons, such as damage caused by an external object or degradation caused by normal use. When an LED string fails, this can disturb the distribution of currents in the remaining LED strings, so the total light output of the LED panel 104 can vary significantly over time.

To help compensate for this problem, the current control unit 106 controls the currents $I_{LED1}$-$I_{LEDn}$ flowing through the LED strings 108*a*-108*n*. As described in more detail below, the current control unit 106 implements dynamic current equalization in order to control the currents $I_{LED1}$-$I_{LEDn}$. If one or more LED strings 108*a*-108*n* fail, the current control unit 106 dynamically adjusts the currents in the remaining strings to compensate. This may allow the system 100 to maintain the light output of the LED panel 104 even when one or more LED strings 108*a*-108*n* fail (or at least provide more illumination than in conventional systems when one or more LED strings fail). The current control unit 106 includes any suitable structure for dynamically controlling currents in multiple LED strings. Details of example dynamic current equalizers and their arrangements in the current control unit 106 are provided below.

The current control unit 106 can equalize the currents in functioning or active LED strings 108*a*-108*n*, allowing the active strings to receive currents according to specified ratios. For example, in some embodiments, the LED strings 108*a*-108*n* can receive substantially equal currents. In other embodiments, the current control unit 106 can apply a scaling factor to one or more currents and equalize the scaled currents. For instance, the current control unit 106 could make first currents in some strings substantially equal, while making a second current in another string substantially equal to twice the first current. This can provide great flexibility in the generation of light, such as by allowing different LEDs (like different colored LEDs) to receive different currents.

Among other things, the use of dynamic current equalization may increase system robustness. Light output could be maintained even when one or several LED strings fail, which reduces the need to replace the LED panel 104 each time an LED string fails. This can significantly reduce maintenance costs associated with the LED panel 104. Moreover, embodiments of the dynamic current equalizers in the current control unit 106 work with standard off-the-shelf AC/DC converters 102 or any other current supply, which can reduce the overall system costs. Further, the dynamic current equalizers could be implemented without requiring the use of switching elements, which can reduce or eliminate concerns regarding electro-magnetic interference (EMI). In addition, the dynamic current equalizers can be easily set up (such as by simply tying a single resistor to each equalizer), reducing installation costs.

Although FIG. 1 illustrates one example of an LED system 100, various changes may be made to FIG. 1. For example, the system 100 could include any number of AC/DC converters, LED panels, and current control units. Also, the use of an AC/DC converter is for illustration only. An input current for an LED panel could be generated or provided by any suitable structure, such as a DC/DC converter or a linear current regulator. Further, the relative positions of the components in FIG. 1 are for illustration only. The illustrated components could be rearranged and additional components could be added according to particular needs. In addition, current equalization can be used in other systems unrelated to LEDs. In these embodiments, the current control unit 106 can be used to control the current through multiple branches of a circuit.

Figure 2:
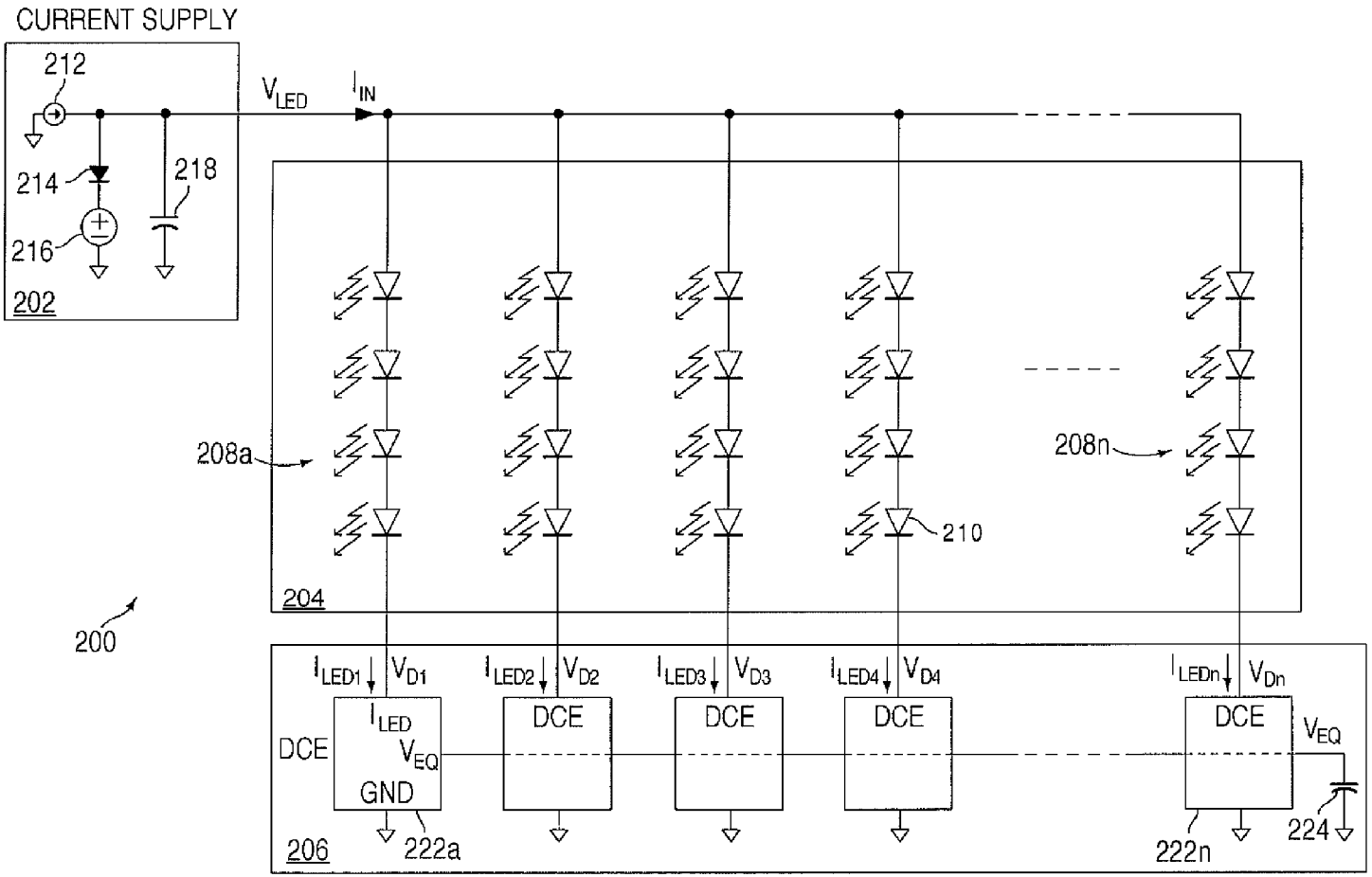
FIG. 2 illustrates a more specific configuration of an example LED system according to this disclosure.

FIG. 2 illustrates a more specific configuration of an example LED system 200 according to this disclosure. The system 200 is similar to the system 100 of FIG. 1, but FIG. 2 illustrates details of particular implementations of various components. In this example, the system 200 includes a current supply 202, an LED panel 204, and a current control unit 206. The LED panel 204 includes multiple strings 208*a*-208*n* of LEDs 210.

As shown in FIG. 2, the current supply 202 includes a current source 212, a diode 214, a voltage source 216, and a capacitor 218. The diode 214 and the voltage source 216 are coupled in series between an output of the current source 212 and ground. The capacitor 218 is also coupled between an output of the current source 212 and ground. Note that the current supply 202 could represent an AC/DC converter, a DC/DC converter, a linear current regulator, or any other suitable structure for providing an input current $I_{IN}$.

The current supply 202 generates the input current $I_{IN}$ for the LED panel 204, which is associated with an LED voltage $V_{LED}$. Assuming an LED string 208*a*-208*n* is functioning properly, the LEDs 210 in that string cause a voltage drop across the string. This results in various voltages $V_{D1}$-$V_{Dn}$ at outputs of the LED strings 208*a*-208*n*. Each LED string 208*a*-208*n* also has an associated current $I_{LED1}$-$I_{LEDn}$ flowing through that string.

In this example, the current control unit 206 includes dynamic current equalizers (DCEs) 222*a*-222*n* coupled to the LED strings 208*a*-208*n*, respectively. The DCEs 222*a*-222*n* regulate the amount of current flowing through active LED strings 208*a*-208*n*. In this particular example, when all LED strings 208*a*-208*n* operate normally, the DCEs 222*a*-222*n* operate such that the currents $I_{LED1}$-$I_{LEDn}$ are substantially equal. If one or more LED strings 208*a*-208*n* fail, the DCEs 222*a*-222*n* adjust the currents such that the currents through remaining (non-failed) LED strings are substantially equal.

In this example embodiment, each DCE 222*a*-222*n* includes an $I_{LED}$ input, which is configured to receive the current $I_{LED1}$-$I_{LEDn}$ flowing through the associated LED string or the voltage $V_{D1}$-$V_{Dn}$ at an output of the string. Each DCE 222*a*-222*n* also receives an equalization voltage $V_{EQ}$. As described below, the equalization voltage $V_{EQ}$ can be set by one of the DCEs 222*a*-222*n* for use by the other DCEs 222*a*-222*n* during current equalization. This allows the DCEs 222*a*-222*n* to operate together to control the currents $I_{LED1}$-$I_{LEDn}$ even as conditions in the LED panel 204 dynamically change. The equalization voltage $V_{EQ}$ may therefore be referred to as a control voltage or control signal, since it is used to control the DCEs 222*a*-222*n*. The equalization voltage $V_{EQ}$ is coupled to a capacitor 224, which represents any suitable capacitive structure having any suitable capacitance (such as a 1 μF or other bulk capacitor). Each DCE 222*a*-222*n* further includes a ground pin. In this example, the DCEs 222*a*-222*n* operate to make the currents $I_{LED1}$-$I_{LEDn}$ through active LED strings substantially equal to $I_{IN}$/N, where N is the number of active (non-failed) LED strings.

Figure 3:
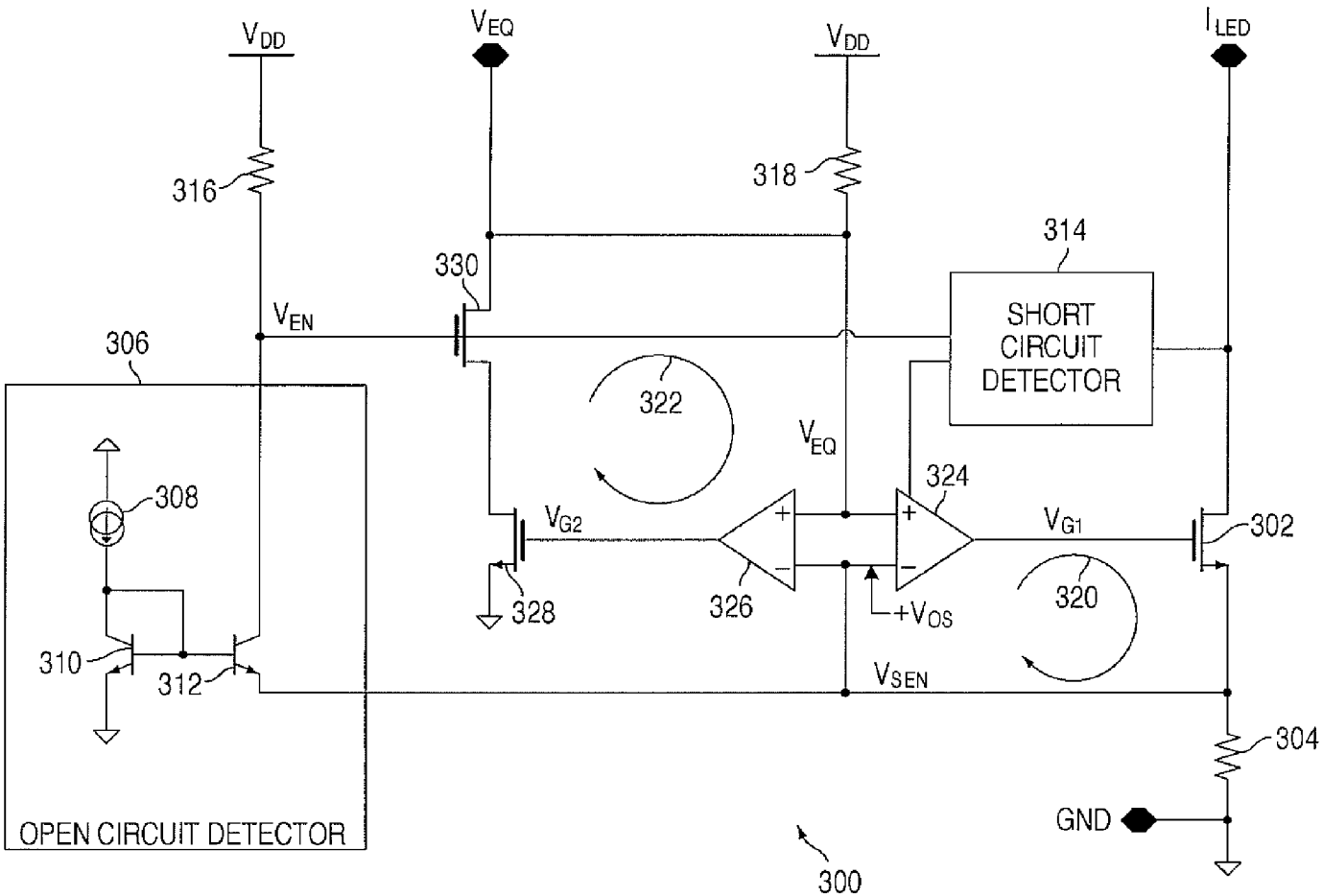
FIG. 3 illustrates an example dynamic current equalizer (DCE) for LED systems according to this disclosure.

FIG. 3 illustrates an example DCE 300 for LED systems according to this disclosure. The DCE 300 could, for example, be used in the current control unit 206 of FIG. 2. As shown in FIG. 3, the DCE 300 includes an LED current pass element 302 and an LED current sense element 304. The pass element 302 controls the amount of current that can pass through an LED string. The sense element 304 senses the amount of current that passes through the LED string and generates a sense voltage $V_{SEN}$ based on the amount of current. In this example, the pass element 302 includes an n-channel lateral diffused metal oxide semiconductor (NLDMOS) transistor, and the sense element 304 includes a resistor.

The DCE 300 also includes an open loop detector 306 that detects when little or no current passes through the pass element 302. This could occur, for example, when an LED string fails and interrupts a current path through the string. In this embodiment, the open loop detector 306 includes a current source 308 and transistors 310-312. The open loop detector 306 here detects when the sense voltage $V_{SEN}$ falls below some threshold (such as 36 mV), which is indicative of an open loop condition. When this condition is detected, the open loop detector 306 pulls an enable signal $V_{EN}$ to a specified level (such as low). The current source 308 includes any suitable structure for generating a current, such as a 10 μA current source. The transistors 310-312 include any suitable transistor devices, such as NPN bipolar transistors.

The DCE 300 further includes a short circuit detector 314, which detects a short circuit condition. A short circuit condition may occur when one or more LEDs of the string fail and form a short circuit. This condition causes the voltage at the output of the string with the short-circuit condition to increase rapidly. The short circuit condition can be detected, for example, when the voltage of any $V_{D1}$-$V_{Dn}$ increases above some threshold. When this condition is detected, the short circuit detector 314 pulls the enable signal $V_{EN}$ to a specified level (such as low) and causes a gate control signal $V_{G1}$ to go to a specified level (such as low) to shut off the pass element 302. The short circuit detector 314 includes any suitable structure for detecting a short circuit condition in a circuit.

The DCE 300 also includes two resistors 316-318. The resistor 316 is coupled to an upper supply voltage rail $V_{DD}$. When the open loop detector 306 and the short circuit detector 314 detect no open or short circuit, the resistor 316 pulls up the enable signal $V_{EN}$. The resistor 318 is also coupled to the voltage rail $V_{DD}$ and pulls up the equalization voltage $V_{EQ}$ if necessary. Each resistor 316-318 includes any suitable resistive structure having any suitable resistance. For example, the resistor 316 could represent a 400 kΩ resistor, and the resistor 318 could represent a 100 kΩ resistor. In other embodiments, the resistors 316-318 could be replaced by current sources or other structures that pull up the enable signal $V_{EN}$ and the equalization voltage $V_{EQ}$, respectively.

In this example, the DCE 300 implements two different regulation loops, namely an $I_{LED}$ regulation loop 320 and a $V_{EQ}$ regulation loop 322. The $I_{LED}$ regulation loop 320 includes the pass element 302, the sense element 304, and a first operational amplifier 324. This regulation loop 320 controls the current flowing through an LED string based on its own sense voltage $V_{SEN}$ and the equalization voltage $V_{EQ}$ received from an external source (such as another DCE). The amplifier 324 receives the equalization voltage $V_{EQ}$ at its non-inverting input and the sense voltage $V_{SEN}$ at its inverting input. The amplifier 324 generates and adjusts the gate control signal $V_{G1}$ for the pass element 302. In this way, the $I_{LED}$ regulation loop 320 regulates the sense voltage $V_{SEN}$ to the equalization voltage $V_{EQ}$ (without attempting to alter the equalization voltage $V_{EQ}$). The amplifier 324 can also drive the gate control signal $V_{G1}$ to a specified level when the short circuit detector 314 detects a short circuit condition. The amplifier 324 includes any suitable amplification structure. In this example, the amplifier 324 is arranged to operate as part of a differential amplifier or a differential gain stage.

The $V_{EQ}$ regulation loop 322 regulates the equalization voltage $V_{EQ}$. In this example, the regulation loop 322 includes a second operational amplifier 326 and transistors 328-330. The operational amplifier 326 receives the current equalization voltage $V_{EQ}$ at its non-inverting input and the sense voltage $V_{SEN}$ at its inverting input. The equalization voltage $V_{EQ}$ may initially represent the voltage generated by the resistor 318. The amplifier 326 generates and adjusts a gate control signal $V_{G2}$ for the transistor 328, allowing the amplifier 326 to further adjust the equalization voltage $V_{EQ}$ towards the sense voltage $V_{SEN}$ using a feedback loop. The transistor 330 can also be cut off to prevent the regulation loop 322 from regulating the equalization voltage $V_{EQ}$ when an open or short circuit condition is detected. The amplifier 326 includes any suitable amplifier structure. In this example, the amplifier 326 is arranged to operate as part of a differential amplifier or a differential gain stage. The transistors 328-330 include any suitable transistor devices. For instance, the transistor 328 could represent an n-channel MOS (NMOS) transistor, and the transistor 330 could represent an NLDMOS transistor.

In this example, the first amplifier 324 includes an input offset, namely an input voltage offset ($V_{OS}$). This offset could be added to the sense voltage $V_{SEN}$. The second amplifier 326 may lack an input offset or have a smaller input offset (meaning the offset of the amplifier 324 minus the offset of the amplifier 326 is positive). This difference in offsets helps to prevent both the regulation loop 320 and the regulation loop 322 from operating at the same time, thereby preventing the DCE 300 from regulating both the LED current $I_{LED}$ and the equalization voltage $V_{EQ}$.

DCEs 300 coupled to different LED strings operate differently depending on the situation. For example, during startup, the open circuit detector 306 can be triggered in each DCE 300, cutting off the transistor 330 and the regulation loop 322 in each DCE 300. The equalization voltage $V_{EQ}$ in each DCE 300 is internally charged up gradually towards the supply voltage by the resistor 318 in that DCE. During this time, the regulation loop 320 in each DCE 300 is regulating its LED current $I_{LED}$ to provide a soft startup.

After startup, the $V_{EQ}$ regulation loop 322 in the DCE 300 associated with the "weakest" LED string begins regulating the equalization voltage $V_{EQ}$. The weakest string represents the LED string with the smallest sense voltage $V_{SEN}$, which would indicate that this LED string has the highest forward voltage and smallest current $I_{LED}$ of any of the LED strings. The DCE 300 associated with the weakest LED string uses its $V_{EQ}$ regulation loop 322 to regulate the equalization voltage $V_{EQ}$, and the operational amplifier 326 in that DCE can regulate $V_{EQ}$ to be substantially equal to the smallest sense voltage $V_{SEN}$. The $I_{LED}$ regulation loop 320 in this DCE 300 can fully turn on the pass element 302 to provide the minimum necessary voltage headroom (thereby providing inherent dynamic headroom control). Effectively, this DCE 300 is adjusting the equalization voltage $V_{EQ}$ based on the smallest current $I_{LED1}$-$I_{LEDn}$ flowing through any of the LED strings. The DCEs 300 associated with the other LED strings cut off their $V_{EQ}$ regulation loops 322 and use their $I_{LED}$ regulation loops 320 to regulate their LED currents based on the equalization voltage $V_{EQ}$.

If the input current $I_{IN}$ increases or decreases, this alters the charge on the capacitor 218 of the current supply 202, which alters the voltage $V_{LED}$. In the DCE 300 for the weakest LED string, the pass element 302 can be in a triode region of operation, so changes to the voltage $V_{LED}$ cause changes to the current $I_{LED}$ and changes in the sense voltage $V_{SEN}$ of that DCE. This causes the DCE 300 to change the equalization voltage $V_{EQ}$, which is then sent to the other DCEs. The other DCEs use the changed equalization voltage $V_{EQ}$ in their $I_{LED}$ regulation loops 320 to alter their currents $I_{LED}$. Note that the capacitor 224 can slow changes in the equalization voltage $V_{EQ}$, which helps to provide soft-start for the currents $I_{LED1}$-$I_{LEDn}$ and to make the $V_{EQ}$ regulation loop 322 a slower regulation loop compared to the $I_{LED}$ regulation loop 320 so that they are not competing with each other.

If the weakest LED string breaks open, the open circuit condition is detected by its DCE 300, and the transistor 330 in that DCE is cut off. This prevents the DCE 300 of the weakest string from regulating the equalization voltage $V_{EQ}$. In each of the other DCEs 300, its equalization voltage $V_{EQ}$ is charged up by the associated resistor 318, and its $I_{LED}$ regulation loop 320 generates a sense voltage $V_{SEN}$ that equals the equalization voltage $V_{EQ}$ plus the offset voltage $V_{OS}$. The currents through those DCEs 300 continue to rise until their sum equals the input current $I_{IN}$, at which point a new weakest LED string is identified (and its associated DCE 300 begins regulating the equalization voltage $V_{EQ}$).

If a non-weakest LED string (a string that is not the weakest string) breaks open, the charge on the capacitor 218 in the current supply 202 increases, which increases the voltage $V_{LED}$. This increases the current $I_{LED}$ and the sense voltage $V_{SEN}$ in the DCE 300 associated with the weakest string. The increase in the sense voltage $V_{SEN}$ causes the DCE 300 to increase the equalization voltage $V_{EQ}$. The other DCEs 300 use the increased equalization voltage $V_{EQ}$ to increase their own LED currents so that the currents through all of the functioning strings total the input current $I_{IN}$.

As can be seen here, the DCEs **222*a*-222*n* can be used to force the currents $I_{LED1}$-$I_{LEDn}$ through functioning LED strings 208*a*-208*n*** to be substantially equal. As a result, the failure of one or several LED strings may cause more current to flow through the remaining LED strings, increasing the light output of the remaining LED strings. Even if the light output decreases somewhat, the light output may still be adequate for the LED panel's intended use, meaning maintenance or repair of the LED panel or system may not be necessary.

Figure 4:
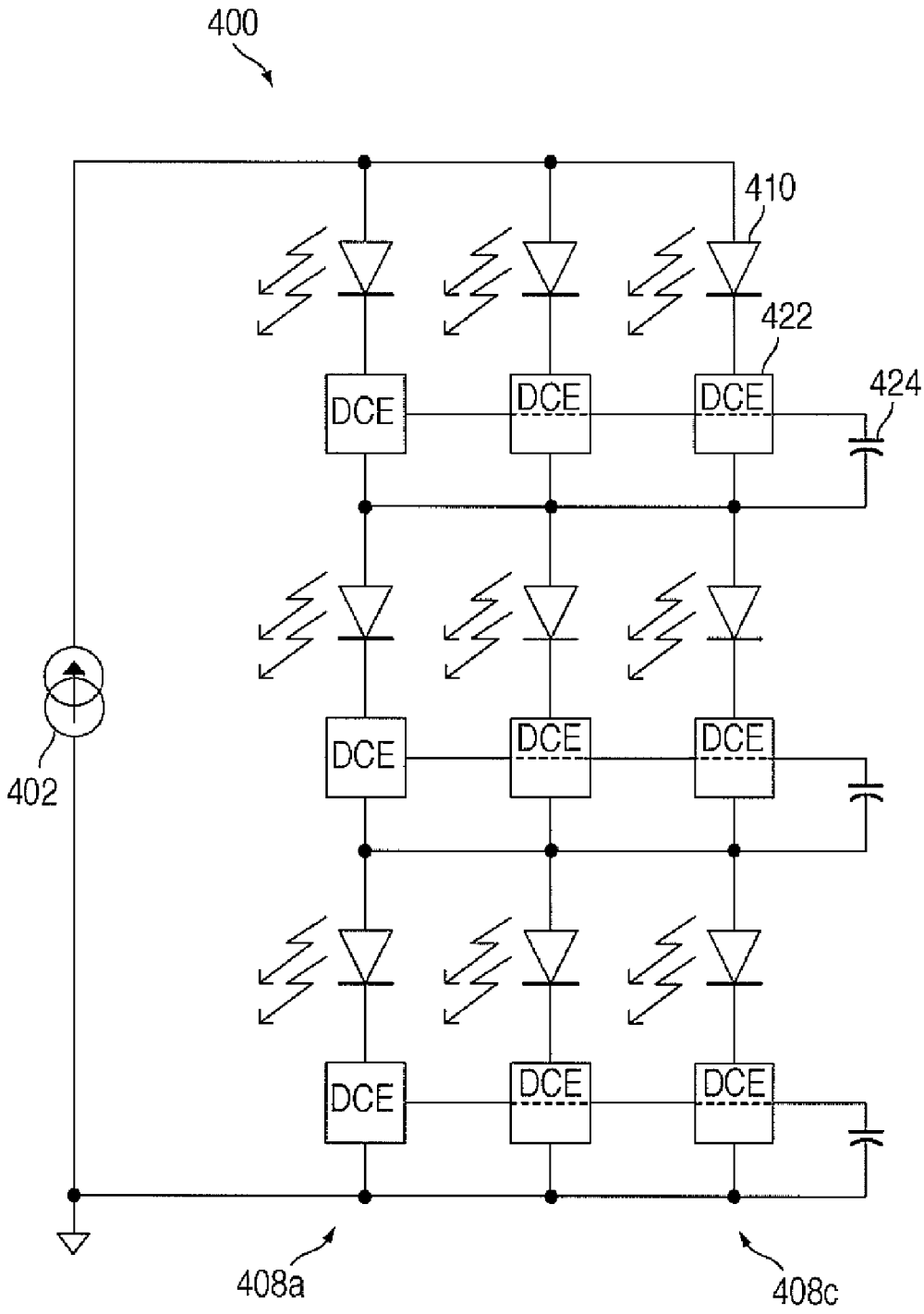
FIGS. 4 through 8 illustrate other configurations of example LED systems according to this disclosure.

In FIG. 2, a DCE is associated with each string **208*a*-208*n* of LEDs. However, other configurations of LEDs and DCEs are also possible. FIGS. 4 through 8 illustrate other configurations of example LED systems according to this disclosure. In FIG. 4, an LED system 400 includes a current supply 402 and multiple LED strings 408*a*-408*c*. Each string 408*a*-408*c* includes multiple LEDs 410, and each LED 410 is associated with its own DCE 422. As a result, each string 408*a*-408*c* is formed by multiple LEDs 410 with DCEs 422 embedded between the LEDs 410. Also, each of multiple capacitors 424 (such as 1 μF capacitors) can be used with a subset of the DCEs 422. Each capacitor 424 can store an equalization voltage $V_{EQ}$ for that subset of DCEs 422**.

Figure 5:
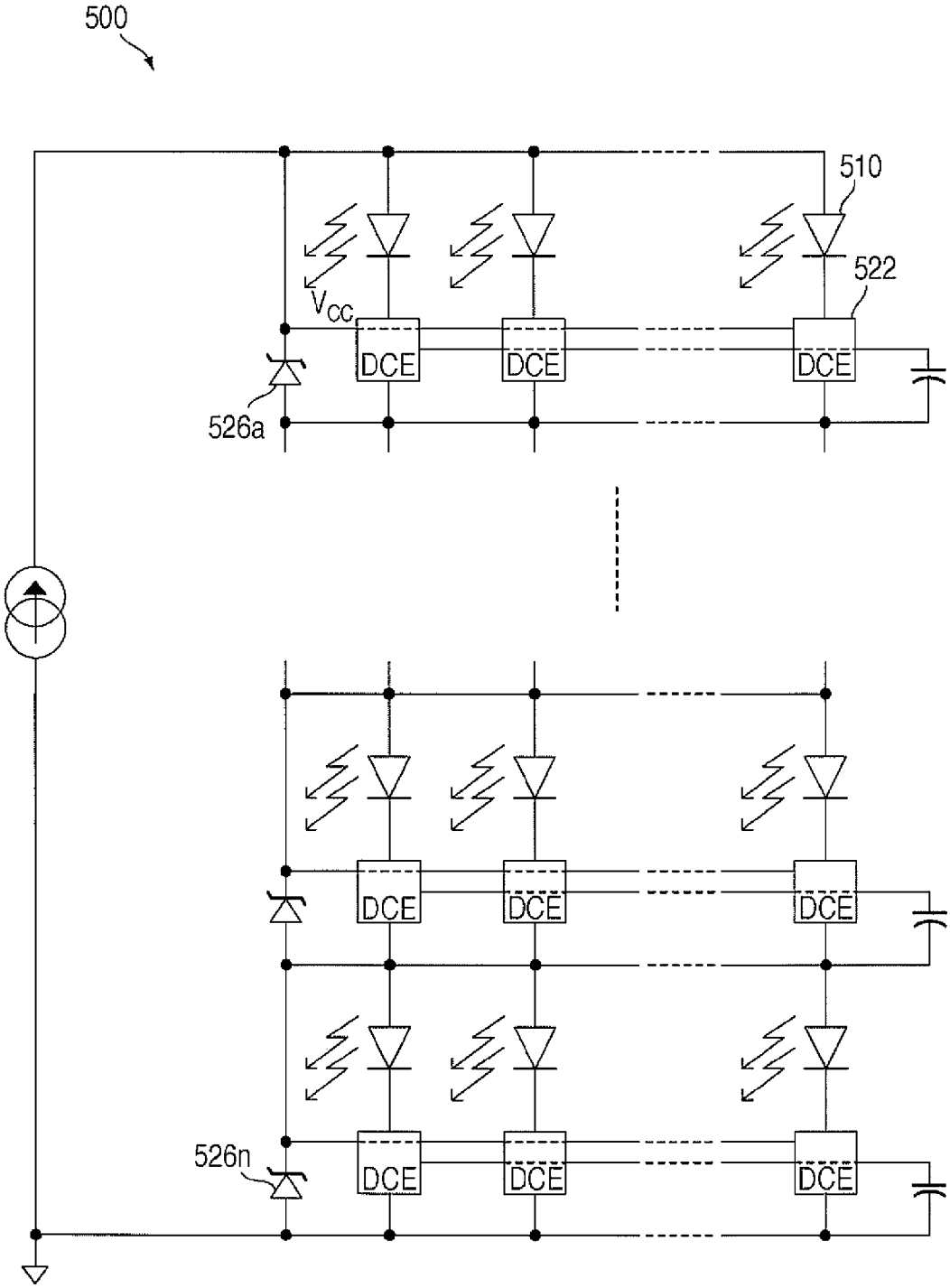

FIG. 5 illustrates an example LED system 500 that is similar in structure to the system 400 of FIG. 4. In FIG. 5, a string of Zener diodes **526*a*-526*n* is coupled between the upper and lower voltage rails. Each Zener diode 526*a*-526*n* is coupled to the supply input $V_{CC}$ of a subset of DCEs 522. The Zener diodes 526***a*-526*n* can be used for power up protection, and they can shunt current when all LEDs 510 coupled in parallel fail.

Figure 6:
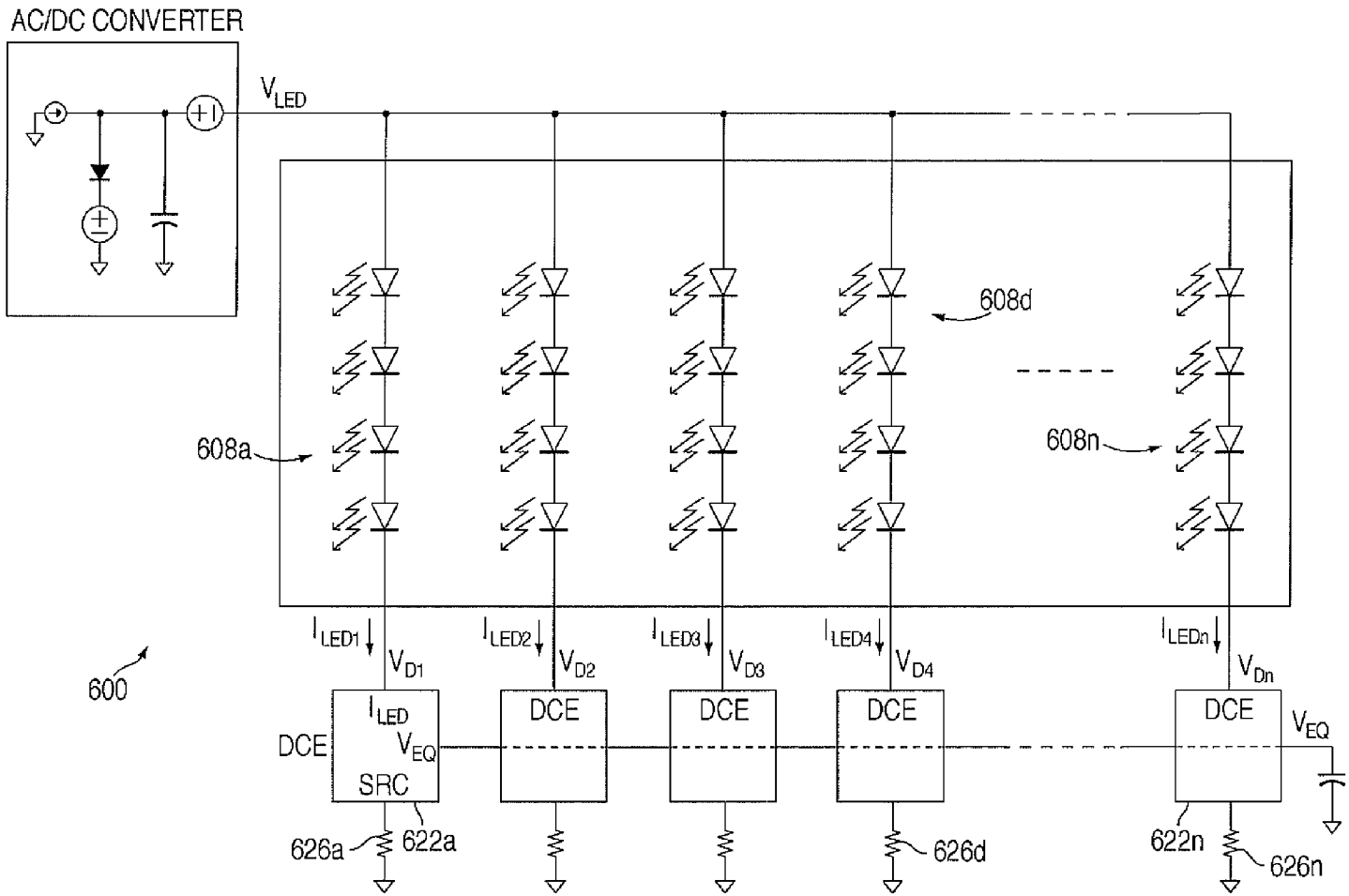

FIG. 6 illustrates an example LED system 600 that is similar to the LED system 200 of FIG. 2. The system 600 includes LED strings 608*a*-608*n* coupled to DCEs 622*a*-622*n*, respectively. Resistors 626*a*-626*n* are coupled to SRC pins of the DCEs 622*a*-622*n*. These resistors 626*a*-626*n* can be used for various purposes. For example, if each of the resistors 626*a*-626*n* has an approximately equal resistance R, it is possible to identify the minimum necessary value of the voltage $V_{LED}$. That is, the minimum value of $V_{LED}$ can be calculated as:

$$V_{LED}=VF_{HIGHEST}+I_{LED}\times(RDS_{ON}+R)$$

where $VF_{HIGHEST}$ denotes the highest forward voltage of any LED string, $I_{LED}$ denotes the current in that LED string, and $RDS_{ON}$ denotes the specific on-resistance of the pass element 302 in the DCE for that LED string. With a known value of R, the minimum necessary $V_{LED}$ voltage can be identified, which can help to minimize voltage overhead. In these embodiments, the DCEs 622*a*-622*n* could operate to make the currents $I_{LED1}$-$I_{LEDn}$ substantially equal.

However, the resistances of the resistors 626*a*-626*n* need not be equal. In fact, all of the resistors 626*a*-626*n* could have a different resistance value. In these embodiments, the specific resistances of the resistors 626*a*-626*n* could be selected to scale the currents $I_{LED1}$-$I_{LEDn}$ in the different LED strings 608*a*-608*n* to obtain different ratios between the currents. For instance, a lower resistance could allow more current to flow through the associated LED string. The current $I_k$ in the kth LED string could be expressed as:

$$I_k = I_{in} \times \frac{R_1 // R_2 // \ldots // R_N}{R_k}$$

where $(R_1//R_2//\ldots//R_N)$ denotes the overall resistance of the parallel resistors 626*a*-626*n* that are associated with active (non-failed) LED strings, and $R_k$ denotes the resistance of the resistor associated with the kth LED string.

This could be useful, for example, when LEDs of different colors are used in the system 600. Assume, for instance, that the strings 608*a*-608*d* include white LEDs, while the string 608*n* includes amber LEDs. Also assume that there are five total strings. The resistors 626*a*-626*d* could each have a resistance of R, while the resistor 626*n* could have a resistance of 2.25×R. With this configuration, 90% of the current $I_{IN}$ may flow through the strings 608*a*-608*d*, while 10% of the current $I_{IN}$ may flow through the string 608*n*. This may be true regardless of changes to the input current $I_{IN}$.

Figure 7:
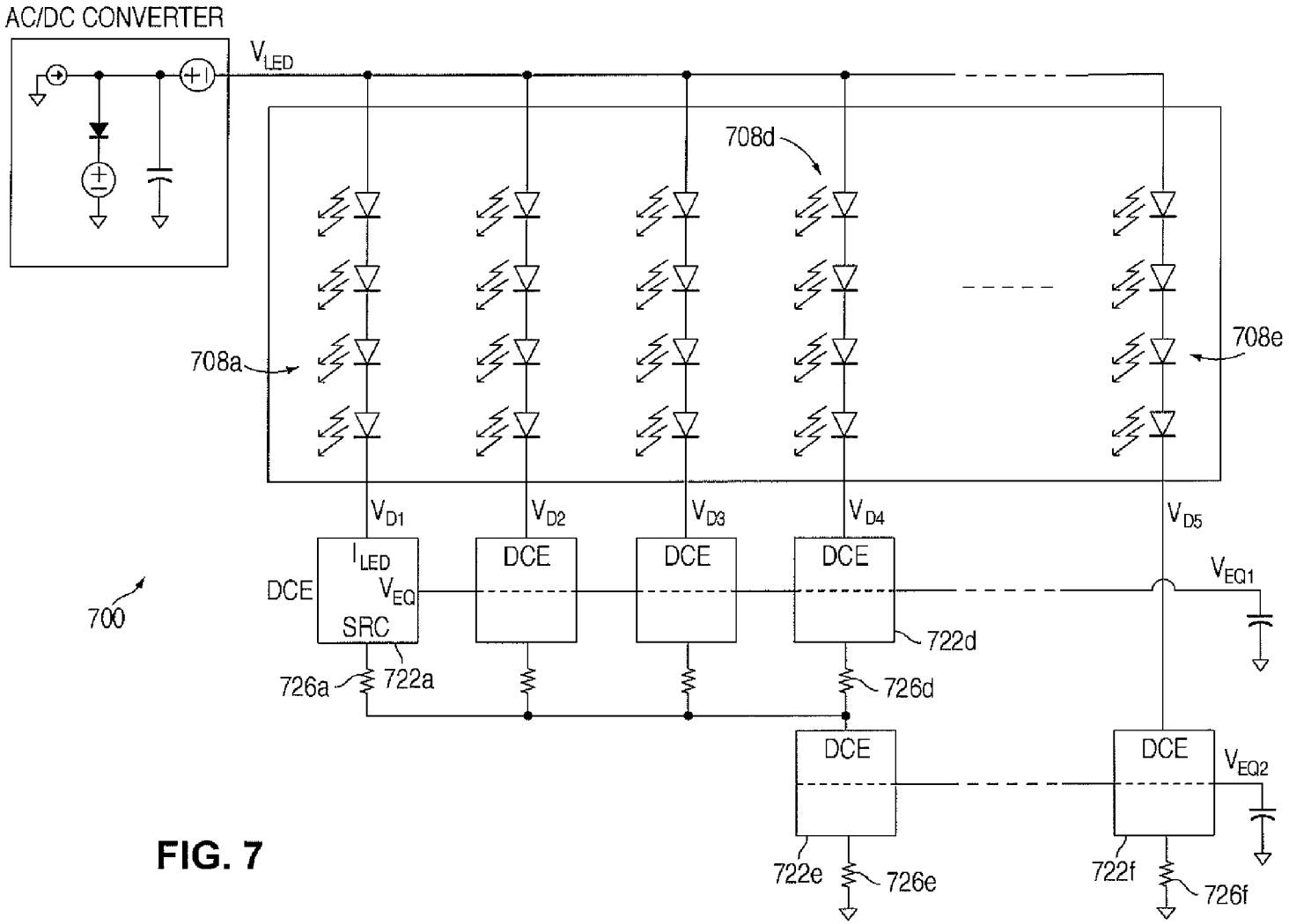

FIG. 7 illustrates an LED system 700 with cascaded DCEs. In FIG. 7, DCEs 722*a*-722*d* are coupled to LED strings 708*a*-708*d*, respectively. Assuming resistances of resistors 726*a*-726*d* are equal, the DCEs 722*a*-722*d* cause the currents through the active LED strings 708*a*-708*d* to be substantially equal. If at least some of the resistors 726*a*-726*d* are unequal, the DCEs 722*a*-722*d* cause the currents through the active LED strings 708*a*-708*d* to achieve the ratios defined by those resistors 726*a*-726*d*. These DCEs 722*a*-722*d* form a first level of DCEs in the system 700.

A DCE 722*e* is coupled to the DCEs 722*a*-722*d*, and a DCE 722*f* is coupled to an LED string 708*e*. The DCEs 722*e*-722*f* form a second level of DCEs in the system 700 and perform another equalization. More specifically, assuming resistances of resistors 726*e*-726*f* are equal, the DCEs 722*e*-722*f* operate such that the total current flowing through the LED strings 708*a*-708*d* substantially equals the current flowing through the LED string 708*e*. In this example, the string 708*e* receives half of the input current $I_{IN}$ (assuming the resistors 726*e*-726*f* are equal) as long as one or more of the strings 708*a*-708*d* are active. The remaining half of the current flows through the active strings 708*a*-708*d*.

In this way, hierarchical equalizations can be enforced using the DCEs. A DCE can control the current through a single string of LEDs, or a DCE can control the current through multiple strings of LEDs (possibly via other DCEs). Although not shown, the DCE 722*f* could be used to control the current through multiple strings of LEDs, and/or one or more additional layers of DCEs could be used in the system 700. This provides great flexibility in how to manage the currents through a number of LED strings.

Figure 8:
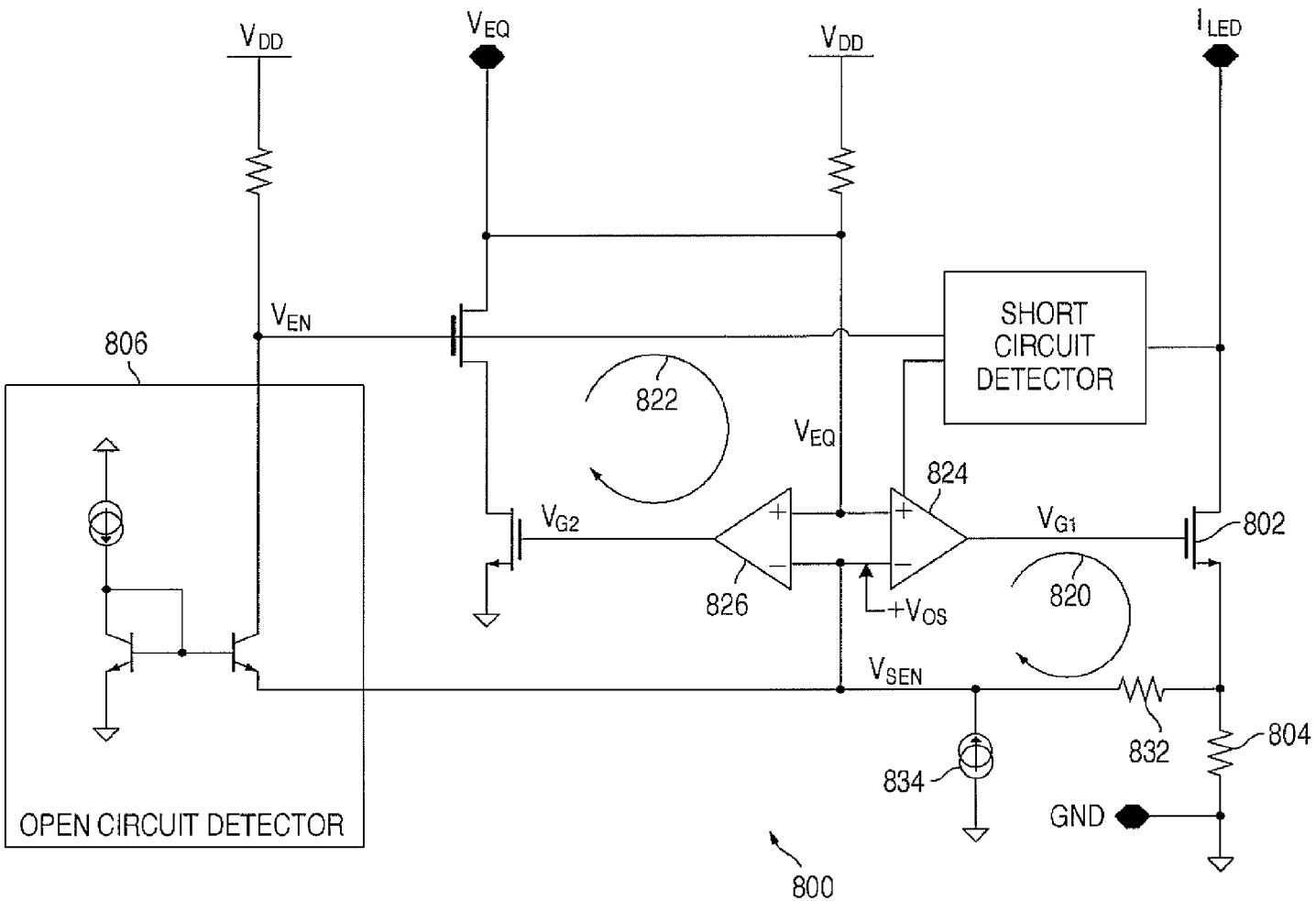

In FIG. 8, a DCE 800 for LED systems is similar in structure to the DCE 300 of FIG. 3. Either DCE could be used in any of the LED systems shown in this patent document. The DCE 800 includes a pass element 802 and a sense element 804. An $I_{LED}$ regulation loop 820 includes a first amplifier 824, and a $V_{EQ}$ regulation loop 822 includes a second amplifier 826.

In this example, the $I_{LED}$ regulation loop 820 further includes a resistor 832 and a current source 834. These components can be used in the DCE 800 to scale the current $I_{LED}$ passing through the pass element 802. Moreover, these components in multiple DCEs 800 can be used to scale multiple currents $I_{LED}$-$I_{LEDn}$ to obtain different ratios between those currents.

Assuming that currents coming out of an open circuit detector 806 and the inverting input terminals of the amplifiers 824-826 are minimal, the sense voltage $V_{SEN}$ generated by the sense element 804 can be offset by a voltage generated by current from the current source 834 flowing through the resistor 832. This offset alters the sense voltage $V_{SEN}$, causing changes to the $I_{LED}$ current through that specific DCE 800.

Although FIGS. 2 through 8 illustrate example arrangements of LED systems and example embodiments of DCEs and other components in those systems, various changes may be made to FIGS. 2 through 7. For example, an LED system could include any number of LEDs and LED strings in any suitable arrangement with any suitable number of DCEs. Also, while certain circuit elements are shown above (such as certain types of transistors or other components), other circuit elements could be used to perform the same or similar functions. In addition, the DCEs can be used in other systems to regulate the currents through multiple branches of a circuit, where those branches may or may not contain LEDs.

Figure 9:
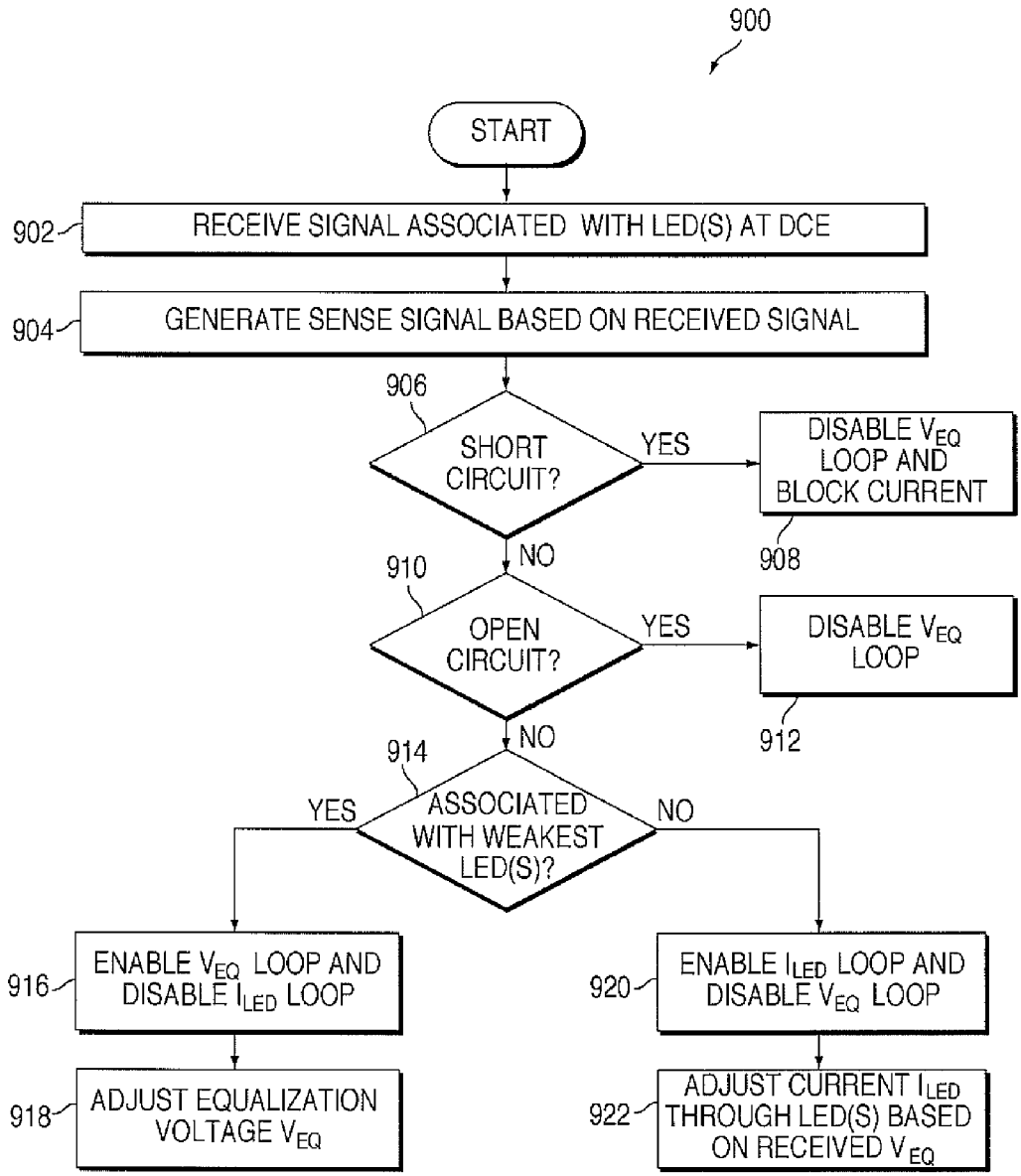
FIG. 9 illustrates an example method for dynamic current equalization in an LED system according to this disclosure.

FIG. 9 illustrates an example method 900 for dynamic current equalization in an LED system according to this disclosure. For ease of explanation, the method 900 is described with respect to the LED system 200 of FIG. 2 operating using the DCE 300 of FIG. 3. The method 900 could be used with any other suitable LED system and DCE configuration.

A signal associated with one or more LEDs is received at a DCE at step 902. This could include, for example, a DCE 222*a*-222*n* receiving a current or voltage associated with a string of LEDs 208*a*-208*n*. The current could represent the current $I_{LED1}$-$I_{LEDn}$ flowing through the string, and the voltage could represent the voltage $V_{D1}$-$V_{Dn}$ at an output of the string. The DCE generates a sense signal based on the received signal at step 904. This could include, for example, the DCE 222*a*-222*n* generating the sense voltage $V_{SEN}$ using the sense element 304.

The DCE determines whether a short circuit condition is detected at step 906. If so, the DCE disables its $V_{EQ}$ regulation loop and blocks current from flowing through the one or more LEDs at step 908. This could include, for example, the short circuit detector 314 causing the amplifier 324 to turn off or open the pass element 302. This could also include the short circuit detector 314 disabling the $V_{EQ}$ regulation loop 322 by cutting off the transistor 330. The DCE determines whether an open circuit condition is detected at step 910. If so, the DCE disables its $V_{EQ}$ regulation loop at step 912. This could include, for example, the open loop detector 306 disabling the $V_{EQ}$ regulation loop 322 by cutting off the transistor 330.

If no open or short circuit condition exists, the DCE is currently receiving a signal from one or more LED(s) that may or may not be the weakest LED(s), such as the weakest LED string. The detection of whether or not the DCE is associated with the weakest LED(s) occurs at step 914, where the sense voltage $V_{SEN}$ can be provided to the amplifiers 324-326, one of which includes an input offset (such as $V_{OS}$).

If the DCE is associated with the weakest LED(s), the DCE enables its $V_{EQ}$ regulation loop and disables its $I_{LED}$ regulation loop at step 916, and the DCE adjusts the equalization voltage $V_{EQ}$ at step 918. In this case, the amplifier 324 outputs a signal that causes the pass element 302 to pass the $I_{LED}$ current. Also, the amplifier 326 adjusts the operation of the transistor 328 to control the equalization voltage $V_{EQ}$ so that it is substantially equal to the sense voltage $V_{SEN}$, which can be output by the DCE to other DCEs for use.

If the DCE is not associated with the weakest LED(s), the DCE disables its $V_{EQ}$ regulation loop and enables its $I_{LED}$ regulation loop at step 920, and the DCE adjusts the current through its LED(s) at step 922. In this case, the amplifier 326 can turn off the transistor 328 to block adjustments to the equalization voltage $V_{EQ}$. Also, the amplifier 324 adjusts the operation of the pass element 302 based on the equalization voltage $V_{EQ}$ received from another DCE to control the current through its LED string.

In this way, the DCE can operate to either (i) regulate the equalization voltage $V_{EQ}$ or (ii) regulate its LEDs' current based on the equalization voltage $V_{EQ}$, but not both. Regulating the equalization voltage $V_{EQ}$ allows the DCE to achieve some control over the currents flowing through other LEDs since the other DCEs regulate their currents based on the equalization voltage $V_{EQ}$. Regulating the LED current based on the equalization voltage $V_{EQ}$ allows the DCE to regulate its current in line with other DCEs.

Although FIG. 9 illustrates one example of a method 900 for dynamic current equalization in an LED system, various changes may be made to FIG. 9. For example, while shown as a series of steps, various steps in FIG. 9 may overlap, occur in parallel, or occur in a different order. Also, the method 900 could be used to regulate the currents through multiple branches of a circuit, where those branches may or may not contain LEDs.

It may be advantageous to set forth definitions of certain words and phrases that have been used within this patent document. The term "couple" and its derivatives refer to any direct or indirect communication between two or more components, whether or not those components are in physical contact with one another. The terms "include" and "comprise," as well as derivatives thereof, mean inclusion without limitation. The term "or" is inclusive, meaning and/or. The phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like.

While this disclosure has described certain embodiments and generally associated methods, alterations and permutations of these embodiments and methods will be apparent to those skilled in the art. Accordingly, the above description of example embodiments does not define or constrain this invention. Other changes, substitutions, and alterations are also possible without departing from the spirit and scope of this invention as defined by the following claims.

What is claimed is:

1. A system comprising:

multiple dynamic current equalizers, each dynamic current equalizer comprising:

a first control loop configured to regulate a current through a circuit branch associated with the dynamic current equalizer, the first control loop comprising a first amplifier having two inputs; and a second control loop configured to regulate a control signal, the second control loop comprising a second amplifier having two inputs coupled to the inputs of the first amplifier, the first amplifier having an input offset compared to the second amplifier;

wherein the dynamic current equalizers are configured such that one dynamic current equalizer regulates the control signal while one or more other dynamic current equalizers regulate the currents through the associated circuit branches based on the control signal.

2. The system of claim 1, wherein each dynamic current equalizer is configured to (i) enable its first control loop while disabling its second control loop and (ii) disable its first control loop while enabling its second control loop.

3. The system of claim 1, wherein the first control loop in each dynamic current equalizer comprises:

the first amplifier;

a pass element configured to be controlled by the first amplifier; and a sense element coupled in series with the pass element and configured to generate a sense signal, the first and second amplifiers configured to receive the sense signal.

4. The system of claim 1, wherein the second control loop in each dynamic current equalizer comprises:

the second amplifier;

a first transistor configured to be controlled by the second amplifier; and a second transistor coupled in series with the first transistor and configured to output the control signal when the second control loop is enabled.

5. The system of claim 1, wherein each dynamic current equalizer further comprises:

at least one of an open circuit detector and a short circuit detector configured to disable the second control loop.

6. The system of claim 1, wherein the dynamic current equalizers are configured to achieve one or more specified ratios between multiple currents flowing through multiple circuit branches, the one or more ratios defined by resistances coupled to the dynamic current equalizers.

7. The system of claim 1, wherein the dynamic current equalizers are arranged hierarchically such that:

a first set of the dynamic current equalizers regulates the currents through a first set of circuit branches; and a second set of the dynamic current equalizers regulates the currents through a second set of circuit branches, the second set of circuit branches including the first set of circuit branches and at least one additional circuit branch.

8. The system of claim 1, wherein the dynamic current equalizer regulating the control signal is configured to regulate the control signal based on a minimum current flowing through the circuit branches.

9. The system of claim 1, wherein:

the circuit branches comprise light emitting diodes (LEDs); and the dynamic current equalizers are configured to substantially maintain a light output of the LEDs by dynamically adjusting the currents in at least some of the LEDs when others of the LEDs fail.

10. A circuit comprising:

a first control loop configured to regulate a current through a circuit branch, the first control loop comprising a first amplifier having two inputs; and a second control loop configured to regulate a control signal, the second control loop comprising a second amplifier having two inputs coupled to the inputs of the first amplifier, the first amplifier having an input offset compared to the second amplifier;

wherein the circuit is configured to (i) regulate the current through the circuit branch without regulating the control signal and (ii) regulate the control signal without regulating the current through the circuit branch.

11. The circuit of claim 10, wherein:

the control signal regulated by the second control loop comprises a first control signal that is output by the circuit; and the first control loop is configured to regulate the current based on a second control signal that is received by the circuit.

12. The circuit of claim 10, wherein the first control loop comprises:

the first amplifier;

a pass element configured to be controlled by the first amplifier; and a sense element coupled in series with the pass element and configured to generate a sense signal, the first and second amplifiers configured to receive the sense signal.

13. The circuit of claim 10, wherein the first control loop further comprises:

a current source and a resistor configured to offset the sense signal.

14. The circuit of claim 10, wherein the second control loop comprises:

the second amplifier;

a first transistor configured to be controlled by the second amplifier; and a second transistor coupled in series with the first transistor and configured to output the control signal when the second control loop is enabled.

15. The circuit of claim 10, further comprising:

at least one of an open circuit detector and a short circuit detector configured to disable the second control loop.

16. The circuit of claim 10, wherein the first control loop is configured to regulate the control signal based on a minimum current flowing through the circuit branch.

17. A method comprising:

receiving a sense signal at a first differential gain stage and a second differential gain stage, the sense signal based on a current flowing through a circuit branch, the first differential gain stage having an input offset compared to the second differential gain stage;

enabling one of a first regulation loop and a second regulation loop using the amplifiers;

regulating the current through the circuit branch when the first regulation loop is enabled; and regulating a control signal when the second regulation loop is enabled.

18. The method of claim 17, wherein regulating the control signal comprises providing the control signal to at least one dynamic current equalizer that regulates at least one second current through one or more additional circuit branches based on the control signal.

19. The method of claim 18, wherein regulating the current comprises regulating the current using a second control signal that is received from one of the at least one dynamic current equalizer.

20. The method of claim 19, wherein regulating the current comprises regulating the current to achieve one or more specified ratios between multiple currents flowing through multiple circuit branches.

* * * * *